United States Patent [19]

Dunnigan

[11] Patent Number: 4,786,056

[45] Date of Patent: Nov. 22, 1988

[54] RANDOM NUMBER GENERATOR

[76] Inventor: Richard P. Dunnigan, 6201 - 25 Mile Rd., Apartment #6, Washington, Mich. 48094

[21] Appl. No.: 114,723

[22] Filed: Oct. 30, 1987

[51] Int. Cl.[4] ..... A63F 9/00

[52] U.S. Cl. ..... 273/144 A

[58] Field of Search ..... 273/144

[56] References Cited

U.S. PATENT DOCUMENTS

| | | | |
|---|---|---|---|
| 2,091,883 | 8/1937 | Rochwarg | 273/144 R |
| 2,203,886 | 6/1940 | Zamora | 273/144 A |
| 2,315,323 | 3/1943 | Fostos | 273/144 A |
| 2,385,980 | 10/1945 | Fostos | 273/144 A |
| 2,594,434 | 4/1952 | Hofsetz | 273/144 A X |
| 2,668,717 | 2/1954 | Staub | 273/144 A |
| 4,185,828 | 1/1980 | Fernandez | 273/144 B X |
| 4,508,346 | 4/1985 | Salvucci | 273/144 B |
| 4,699,382 | 10/1987 | Kabana | 273/144 B |

FOREIGN PATENT DOCUMENTS

| | | | |
|---|---|---|---|
| 148995 | 3/1952 | Australia | 273/144 B |
| 1122421 | 1/1962 | Fed. Rep. of Germany | 273/144 B |
| 896488 | 5/1962 | United Kingdom | 273/144 A |
| 1015047 | 12/1965 | United Kingdom | 273/144 B |
| 8400115 | 1/1984 | World Int. Prop. O. | 273/144 B |

*Primary Examiner*—Paul E. Shapiro

*Attorney, Agent, or Firm*—Harness, Dickey & Pierce

[57] ABSTRACT

A random number generator assembly for mixing and randomly selecting balls indicating events or numbers is described which includes a chamber for mixing the numbers and a storage device communicating therewith for storing the numbers which have been generated. The mixing chamber is constructed from transparent plastic forming an octagonal drum. Motion of the balls within the mixing chamber is provided by a blower having sharply bent blades rotated with the convex side in the direction of travel to displace air within the mixing chamber. Within the mixing chamber, a multi-planar ramp made of expanded metal serves to increase the mixing effect of the balls providing more complete and rapid randomization of the balls. A transparent plastic tube communicates with the mixing chamber and serves to store random numbers which have been generated by the passage of balls from the mixing chamber to the storage device. A photoelectric beam senses the generation of the random numbers. A counter mechanism turns the generator off when a preset number of balls have been counted.

13 Claims, 2 Drawing Sheets

RANDOM NUMBER GENERATOR

BACKGROUND AND SUMMARY OF THE INVENTION

The present invention relates generally to mechanical random number generators, and more particularly to a device for mixing objects representing numbers, letters, or other character indicia and randomly selecting a predetermined quantity of such objects.

Many games of chance are based upon the occurrence of random events in a fixed universe of possible random events. These games typically involve the prediction by an individual that a desired set of random events such as the occurrence of a certain set of random numbers out of a larger but fixed universe of possible random numbers will result from the game. Public interest in this form of amusement has progressed from local bingo games and fairs to the adoption of government-run lotteries in many states. All these games require a device which most nearly creates a truly statistically random selection of events. Player confidence in the system must be maintained by use of a random number generator whose operation the participants can see and understand while still creating this statistically near-perfect randomness.

Random numbers generated by a properly programmed computer may be theoretically capable of approaching a statistically perfect random number mix. Computer generation, however, is unsuitable for most games in that the participants cannot see or oftentimes understand the process by which the numbers are generated and may therefore lack confidence in the random number selection. Likewise, any human intervention in the process of selecting the random numbers should be reduced or eliminated so as to correspondingly reduce the chance of operator-induced bias in the selection of random numbers. This near-perfect statistical randomness must be achieved in a low-cost, easy to maintain device, in order to have applicability for use by a wide variety of organizations. Due to the nature of the above-identified design constraints, a need exists to provide a random number generator which will satisfy the above requirements and yet be economical to manufacture and operate.

Accordingly, it is a principal object of the present invention to provide a mechanical random number generator that achieves a high degree of randomness while being economical to manufacture and operate.

Another object of the present invention is to provide a random number generator which is adapted to minimize operator-induced bias.

It is a further object of the present invention to provide a random number generator which can be set up to provide random numbers for a wide variety of games.

To achieve the foregoing objects, the present invention provides a unique mixing chamber for randomizing the selection of one or more marked balls contained therein. In one form of the present invention, the mixing chamber is constructed of transparent rigid plastic walls which have the shape of an octagonal drum. Once the balls are placed within the mixing chamber, no further operator intervention with the balls is required to operate and reset the random number generation.

A blower is disposed below a perforated floor of the mixing chamber so as to push air through the mixing chamber. This current of air creates a vortex which causes the balls to move in circular motion around the periphery of the mixing chamber. The contact of the balls with the facets of the mixing chamber cause the balls to bounce as opposed to traveling in a smooth or ordered swirling motion. This bouncing increases the mixing effect by causing individual balls to be cast in a random or unpredictable fashion around the mixing chamber.

Attached within the mixing chamber is a multi-planar ramp. A portion of the balls revolving about the periphery of the mixing chamber will contact the base of the multi-planar ramp and their direction will be changed. Rather than remaining toward the bottom of the mixing chamber, the ramp redirects the balls by imparting a vertical or upward component to their travel. The ramp causes some balls to be moving in primarily vertical direction while the others remaining toward the bottom of the mixing chamber are moving in a primarily horizontal direction. The splitting of the balls into different travel paths permits more rapid randomization.

One wall of the mixing chamber is provided with an aperture which allows balls to randomly pass therethrough and out from the mixing chamber. The passage of a ball through this aperture is considered the generation of a random number.

Mounted to the exterior of the mixing chamber is a tube for storing the balls representing the random numbers generated.

Additionally, a counter can be associated with the storage tube for counting the number of balls exiting the mixing chamber, and stopping the operation of the random number generator when a preset quantity of balls have been generated.

Additional advantages and features of the present invention will become apparent from a reading of the detailed description of the preferred embodiments.

DETAILED DESCRIPTION OF THE PREFERRED EMBODIMENT

Figure 1:
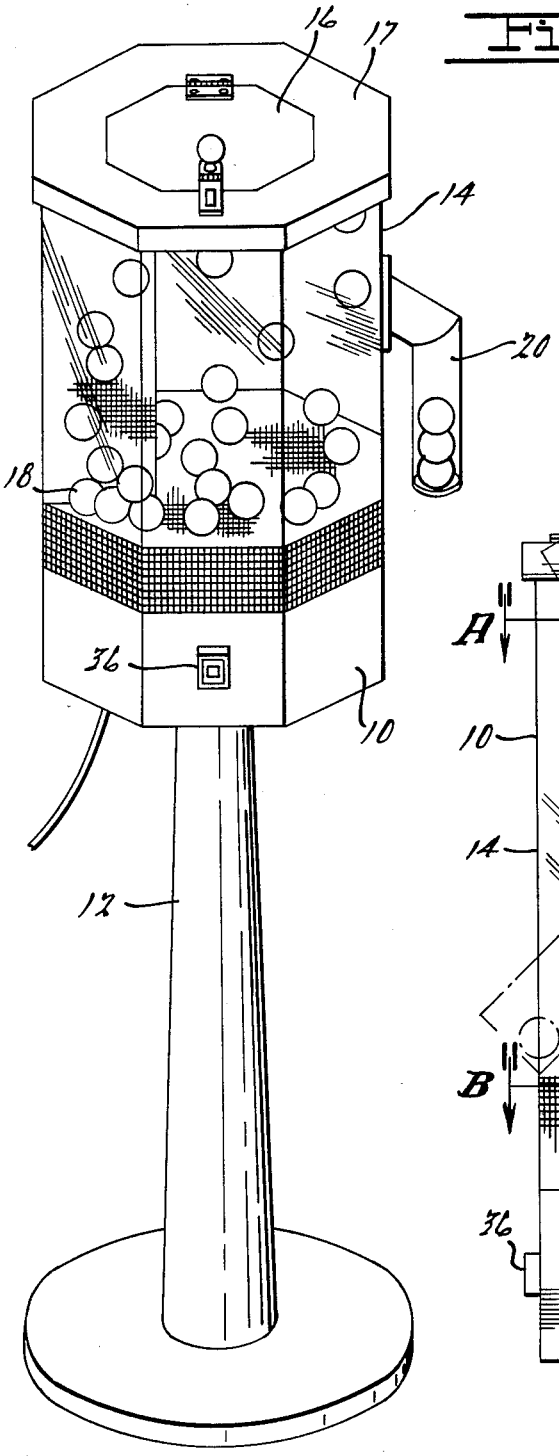
FIG. 1 is a perspective view of a random number generator according to the present invention.

Referring to FIG. 1, a perspective view of a random number generator assembly 10 according to the present invention is shown. The random number generator assembly 10 generally includes a support stand 12 upon which is secured a mixing chamber assembly 14. An access port 16 is provided in the cover 17 of the mixing chamber assembly 14 to allow insertion or removal of a plurality of objects or balls 18 within the mixing chamber assembly 14. The balls should be provided with the numbers, letters or other character indicia which is desired in the game for which the random number generator is intended. The balls should be small and lightweight, such as ping-pong balls, polystyrene balls and the like. In this regard, the size of the mixing chamber should be selected to accommodate the number or quantity of balls needed for the game (e.g., 44 balls are required for some lottery games). Secured to the side of the mixing chamber assembly 14 is a storage tube 20 where generated random numbers are stored until the random number generator assembly 10 is reset for its next operation.

Figure 2:
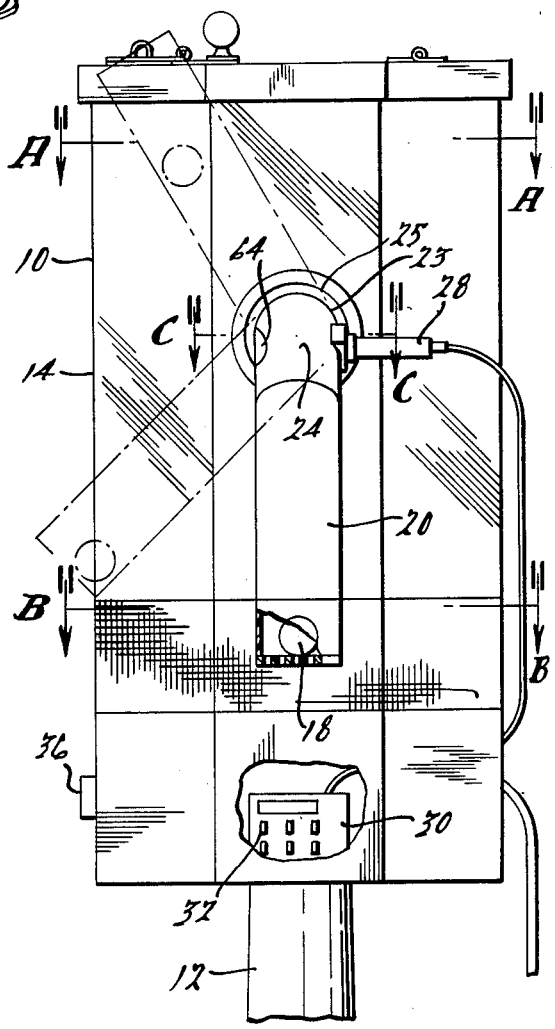
FIG. 2 is an elevational view of the portion of the random number generator shown in FIG. 1.

Referring to FIG. 2, an elevational view of the mixing chamber assembly 14 is shown. The storage tube 20 is shown to be connected to the side of the mixing chamber assembly 14 by means of a rotatable joint 22, which is disposed around an aperture 24 in the mixing chamber assembly 14. The rotatable joint 22 permits the storage tube 20 to be rotated with respect to the mixing chamber 14 so that any balls 18 within the storage tube 20 can be returned to the mixing chamber assembly 14 by means of gravity. As detailed in FIG. 6, the rotatable joint 22 has a flange 23 affixed to the end of the storage tube 20. The flange 23 has a diameter larger than the aperture 24. The flange 23 is mounted on the outside of the mixing chamber assembly 14 by a collar 5 which creates a groove 27 within which the flange 23 may rotate. Thus, while the storage tube 20 could be removably connected to the mixing chamber, there is no need to do so with the swivelable joint according to the present invention.

Returning to FIG. 2, the random number generator assembly 10 is considered to have generated a random number when a ball 18 passes through the aperture 24 into the storage tube 20. A photoelectric scanner 28 is secured to the side of the storage tube 20 and aligned to pass its beam across the storage tube 20 near the aperture 24. When a ball 18 passes through the aperture 24, it breaks the beam of infrared light from the photoelectric scanner 28 causing the photoelectric scanner 28 to generate an impulse to the counter 30. The counter 30 can be programmed via its keyboard 32 to count a preset number of impulses from the photoelectric scanner 28. Once the preset number of impulses has been received by the counter 30, the counter 30 will operate as a switch to cut outside power to the random number generator assembly 10. It has been found that a suitable photoelectric scanner 28 is manufactured by the Automatic Timing and Controls Company located in King of Prussia, Pa., 19406 and sold as the Series 7252 beam switch. The counter in such an embodiment can be the Model LNXCC contact input counter manufactured by the Red Lion Company.

The storage tube 20 can also be equipped with a sensing means to scan the generated random numbers and indicate to participants the identity of the numbers generated. This feature may be desirable in situations where the random number generator assembly 10 is operating before a large ground of people, some of whom are not able to see the actual generated numbers in the storage tube 20. In such a situation, the generated numbers can be displayed in enlarged form such as by a magnifying projector or by holographic reproduction.

Figure 3:
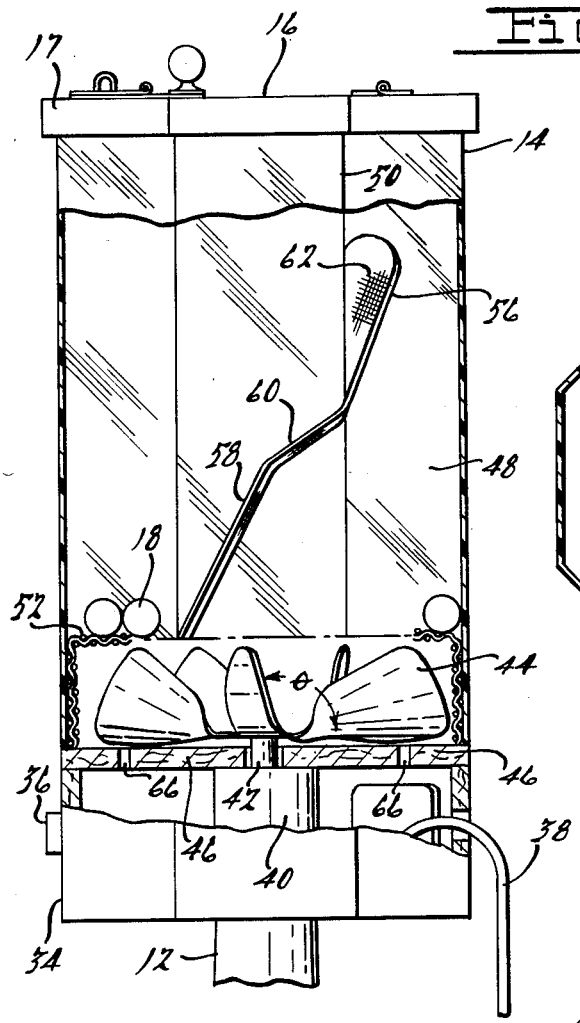
FIG. 3 is a fractional cross-sectional view of the random number generator shown in FIG. 1.

Referring to FIG. 3, an elevational view of the random number generator assembly 10 according to the present invention is shown with the mixing chamber 14 in partial cut-away. The mixing chamber assembly 14 consists of a housing 34 upon which is mounted power switch 36 which serves to connect an electrical power source 38 to a fan motor 40. The fan motor 40 drives the blower 42 which has blades 44 bent to a near 90° angle as represented by theta. The blades are rotated so as to present their convex surface (e.g. in FIG. 3 the direction of travel would be clockwise). The sharp bend in the blades causes the blower to draw air through the perforated housing top 46 and create a vortex within the mixing chamber 48.

The mixing chamber 48 is made from transparent rigid plastic walls 50 butted together to make a multifaceted circumference. The interior of the mixing chamber 48 is separated from the blower 42 by means of an expanded metal or wire mesh floor 52. The mixing chamber 48 is sealed at the top by a cover 17 with an access port 16 contained therein.

Secured to the mixing chamber floor 52 is a ramp 56 which terminates at a plane intermediate the mixing chamber floor 52 and the mixing chamber cover 17. In a preferred embodiment, the ramp 56 is made of expanded metal or wire mesh so that the vortex of air is allowed to pass through the ramp 56 rather than being directed upwards toward the top of the chamber. One side of the ramp 56 follows the contour of the wall 50. In a preferred embodiment, the ramp does not lie in the single plane but rather is multi-planar consisting of a first plane 58, a second plane 60, and a third plane 62.

Operation of the random number generator assembly 10 is initiated by operation of the power switch 36 which causes the fan motor 40 to revolve the blower 42. The passage of air through the perforated housing top 46 and into the mixing chamber assembly 14 creates a vortex in the mixing chamber 48.

Figure 4:
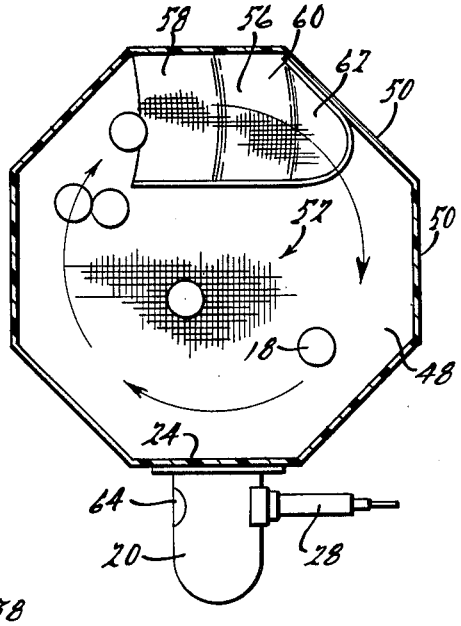
FIG. 4 is a cross-sectional view of the random number generator shown in FIG. 2 through the line A—A.

Turning to FIG. 4, a cross-sectional view of the random number generator assembly 10 through the plane represented by A—A in FIG. 2 is shown. The vortex of moving air causes the balls 18 to rotate in a clockwise direction with very little vertical component to their motion. A portion of the balls 18 will contact the first plane 58 of the ramp 56 while those balls 18 not contacting the ramp will continue in a clockwise rotation. Those balls 18 contacting the first plane 58 of the ramp 56 will begin to accumulate at the juncture of the first plane 58 and the mixing chamber floor 52 when, as in one preferred embodiment, the angle of the first plane 58 with respect to the mixing chamber floor 52 is steep enough to prevent rapid passage of the balls 18 over the frist plane 58. Additional balls 18 moving in the clockwise direction for forced up and over the balls that have collected at the base of the first plane 58. The balls 18 that have collected at the base of the first plane 58 slowly migrate up the ramp 56. The additional balls moving up and over them are traveling at a higher velocity. The balls 18 being forced up and over the balls 18 collecting at the base of the first plane 58 will randomly dislodge certain balls 18 that had collected at the base of the first plane 58 and are now migrating up the ramp 56. There are two streams of balls 18 traveling along the ramp 56. One stream is the balls migrating along its first plane 58. The second stream is the balls 18 moving over the first stream at a higher velocity. Both streams converge at the second plane 60 where they mix.

The angle of the second plane 60 with respect to the mixing chamber floor 52 should be less than the angle of the first plane 58 with respect to the mixing chamber floor 52. As the balls pass over the second plane 60, the vortex of air causes them to pick up speed due to the reduced incline of the second plane 60 while still adding a vertical component to their motion. The balls pass over the second plane 60 then contact the third plane 62 of the ramp 56. The third plane 62 has a greater angle with respect to the mixing chamber floor 52 than the second plane 60 has with respect to the mixing chamber floor 52. The third plane 62 is also skewed or canted with respect to the first plane and second plane 58 and 60 so as to impart in addition to a vertical component to the motion of the ball 18, some clockwise rotational movement, also. When the ball 18 is passed over the third plane 62, it travels through the interior of the mixing chamber 48 until it contacts a wall 50. Depending upon the angle of incidence of the ball 18 with the wall 50, the ball may collide with one or more additional walls 50 until gravity returns it to the mix of balls on the mixing chamber floor 52. The angles of the ramp 56 and the strength of the air vortex should be calculated so that many of the balls passing over the third plane 62 will collide with the wall 50 containing the aperture 24. A portion of the balls that are headed for the wall 50 that contains the aperture 24 will pass through the aperture 24 at which point they will be considered a generated random number. The aperture 24 should be sized so that all the balls 18 in the mixing chamber 48 have gone through several cycles of swirling about the mixing chamber floor 52 and traversing the ramp 56 before the desired quantity of their number have passed through the aperture 24. In one preferred embodiment, the aperture is sized at slightly less than twice the diameter of the ball 18 so as to reduce the rate at which balls 18 pass through the aperture. The smaller the aperture 24, the slower the rate at which the balls will pass through it and therefore, the longer time they will be mixed within the mixing chamber 48.

Once the ball 18 has passed through the aperture 24, it will be counted by breaking a beam of light projected by the photoelectric scanner 28 which is registered as the generator of a random number at the counter 30. To increase the accuracy of the photoelectric scanner 28 and reduce inaccuracies induced by unwanted reflections, the storage tube 20 can be provided with a background screen 64 opposite where the photoelectric scanner 28 is mounted. The background screen 64 should be of a color opposite that of the predominant color in the ball 18 so that the passage of the ball 18 between the photoelectric scanner 28 and the background screen 64 creates a marked contrast. In one embodiment, standard white ping-pong balls are used for the random number indicia 18 and a black color is selected for the background screen 64 to provide maximum contrast with the white ping-pong balls, therefore reducing error in the operation of the photoelectric scanner 28. Whenever the photoelectric scanner 28 has its beam broken, it generates an impulse to the counter 30 (as shown in FIG. 2). When the counter 30 has received a number of impulses equalling the preset number of impulses, the counter opens a switch interrupting electrical power to the fan motor 40 (as shown in FIG. 3). With the fan motor 40 interrupted, the balls 18 still remaining in the mixing chamber 48 will quickly come to rest. Once electrical power is interrupted to the fan motor 40, no additional balls 18 should pass through aperture 24 resulting in additional random numbers being generated. To further reduce the likelihood of additional random numbers being generated after the preset number have been generated, a shutter (not shown) can be displaced to seal off the aperture 24 when the counter 30 indicates the preset levels of random numbers have been generated.

Figure 6:
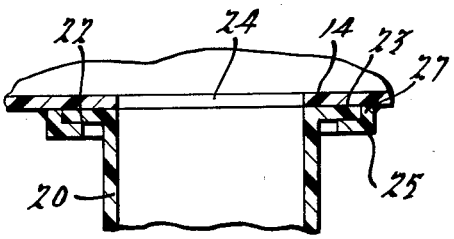
FIG. 6 is a cross-sectional view of the swivel joint shown in FIG. 2 through the line C—C.
Figure 5:
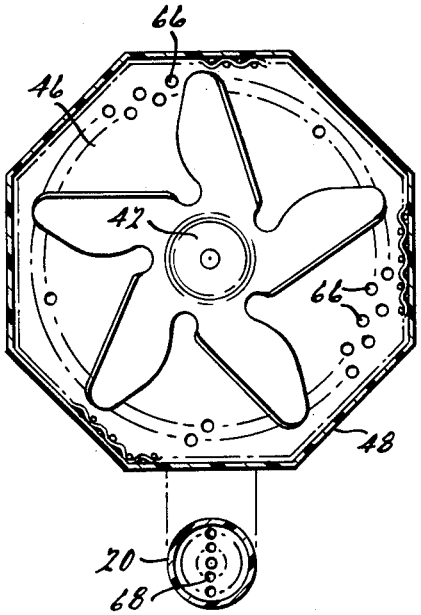
FIG. 5 is a cross-sectional view of the random number generator shown in FIG. 2 through the line B—B.

Referring to FIG. 6, a cross-sectional view of a random number generator assembly 10 through the plane B—B as shown in FIG. 2 is shown. Intake apertures 66 are illustrated in the perforated housing top 46. Exhaust apertures in the base of the storage tube 20 are also illustrated. Operation of the blower 42 causes air to be drawn through the intake aperture 66 creating a vortex within the mixing chamber 48 and being exhausted through the exhaust aperture 68.

The various embodiments which have been set forth above were for the purpose of illustration and were not intended to limit the invention. It will be appreciated by those skilled in the art that various changes and modifications may be made to these embodiments described in the specification without departing from the spirit and scope of the invention as defined in the appended claims.

What is claimed is:

1. A random number generator comprising:

a substantially transparent mixing chamber having an exit aperture;

blower means disposed below a perforated floor of said mixing chamber for directing air into said mixing chamber;

ramp means positioned within said mixing chamber in a predetermined relationship with said aperture for causing a plurality of objects provided with random event indicia to be propelled upwardly by displaced air from said blower means and circulated within said mixing chamber;

and storage means in communication with said aperture for receiving objects exiting said mixing chamber through said aperture.

2. The random number generator of claim 1, wherein said mixing chamber comprises a drum having multifaceted walls for increasing the level of randomness and mixing within said mixing chamber.

3. The random number generator of claim 2, wherein said ramp means comprises a perforated multi-planar incline.

4. The random number generator of claim 3, wherein said storage means comprises:

a discharge chute for displaying objects exiting from said mixing chamber through said aperture; and counter means associated with said discharge chute for deactivating said blower means when a predetermined number of said objects have exited from said mixing chamber.

5. The random number generator of claim 4, wherein said blower means comprises a plurality of fan blades formed to a substantially 90° bend and rotated to present a convex surface in the direction of travel.

6. The random number generator of claim 5, wherein said storage means comprises a tube having having a first end connected around said aperture of said mixing chamber and a second end provided with a perforated cover.

7. The random number generator of claim 6, wherein said storage means is rotatably affixed to said mixing chamber at said first end.

8. The random number generator of claim 7, wherein said storage means includes scanner means for indicting the exiting of one of said objects from said mixing chamber.

9. The random number generator of claim 8, wherein said storage means further including counter means for counting the number of said objects which have exited said mixing chamber.

10. The random number generator of claim 9, wherein said storage means further includes switch means for deactivating said blower means when a preset quantity of said objects have exited said mixing chamber.

11. A random number generator comprising:

chamber means for visibly containing and mixing a plurality of balls each having character indicia associated therewith;

displacement means for imparting a swirling motion to said balls within said chamber means;

direction control means for imparting an upward motion to said balls within said chamber means;

storage means for randomly capturing and holding at least one of said balls;

counter means for stopping said displacement means when a preset number of said balls have been captured by said storage means.

12. The random number generator of claim 11, wherein said displacement means comprises a blower further comprising a plurality of blades bent to a near 90° angle and rotated so as to present their convex face.

13. A random number generator comprising:

octagonally faceted transparent plastic chamber means for visibly containing and mixing a plurality of random event indicia;

convex blade blower means for imparting a swirling motion to said random event indicia;

expanded metal ramp means for imparting an upward motion to said random event indicia within said chamber means;

transparent plastic storage means for capturing and holding at least one said random event indicia;

counter means for stopping said displacement means when a preset quantity of said balls have been captured by said storage means.

* * * * *